US009707573B1

(12) United States Patent
Huang

(10) Patent No.: US 9,707,573 B1
(45) Date of Patent: Jul. 18, 2017

(54) CONTROLLER OF WATER DISPENSING APPARATUS

(71) Applicant: YUAN-MEI CORP., Changhua County (TW)

(72) Inventor: Po-Chao Huang, Changhua County (TW)

(73) Assignee: YUAN-MEI CORP., Changhua County (TW)

( * ) Notice: Subject to any disclaimer, the term of this patent is extended or adjusted under 35 U.S.C. 154(b) by 0 days.

(21) Appl. No.: 15/001,181

(22) Filed: Jan. 19, 2016

(51) Int. Cl.

| | |
|---|---|
| ***B05B 1/12*** | (2006.01) |
| ***B05B 1/30*** | (2006.01) |
| ***B05B 12/00*** | (2006.01) |
| ***B05B 15/06*** | (2006.01) |

(52) U.S. Cl.
CPC ..... *B05B 1/12* (2013.01); *B05B 1/3046* (2013.01); *B05B 12/002* (2013.01); *B05B 15/061* (2013.01)

(58) Field of Classification Search
CPC ..... B05B 1/12; B05B 1/3033; B05B 1/304; B05B 1/3046; B05B 1/3066; B05B 1/3073; B05B 1/308; B05B 9/01; B05B 12/002; B05B 15/061
USPC ..... 239/451, 456, 457, 505, 513–515, 525, 239/526, 581.1, 581.2, 582.2, 583
See application file for complete search history.

(56) References Cited

U.S. PATENT DOCUMENTS

| | | | | |
|---|---|---|---|---|
| 7,124,965 | B1 * | 10/2006 | Chen | A62C 31/02 239/416.4 |
| 7,226,002 | B2 * | 6/2007 | Luo | B05B 1/308 239/390 |
| 7,533,833 | B2 * | 5/2009 | Wang | B05B 1/1681 239/443 |
| 8,087,597 | B2 * | 1/2012 | Cheng | B05B 1/12 239/525 |
| 8,123,151 | B2 * | 2/2012 | Cheng | B05B 1/3026 239/525 |
| 8,490,948 | B2 * | 7/2013 | Lu | A01G 25/00 239/526 |
| 8,596,558 | B2 * | 12/2013 | Lai | B05B 9/01 239/525 |
| 2006/0249599 | A1 * | 11/2006 | Guo | F16K 35/025 239/530 |

* cited by examiner

*Primary Examiner* — Darren W Gorman
(74) *Attorney, Agent, or Firm* — Raymond Y. Chan; David and Raymond Patent Firm

(57) ABSTRACT

A water dispensing apparatus includes a dispensing body including a nozzle, a control valve including a water sealing member and a pusher member, an actuation member coupled to the pusher member, and a control unit to drive the control valve to rotate. When the control valve is driven to rotate, the pusher member is driven to move correspondingly to reciprocatingly move the actuation member at different locations of the nozzle not only for switching on-and-off the control valve but also for controllably shifting different water spraying patterns of the nozzle. Therefore, is able to easily control different operations of the water dispensing apparatus in one single continuous action of the control unit.

8 Claims, 12 Drawing Sheets

CONTROLLER OF WATER DISPENSING APPARATUS

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a water dispensing apparatus, and more particularly to a controller of a water dispensing apparatus, which comprises an actuation member being reciprocatingly actuated not only for switching on-and-off the water dispensing apparatus but also for controllably shifting different water spraying patterns, such that the user is able to easily control different operations of the water dispensing apparatus in a one hand operatable manner.

DESCRIPTION OF RELATED ARTS

A conventional water dispensing apparatus generally comprises a valve control provided with a single common function that the valve control can only be operated for selectively controlling to turn on or off the water dispensing apparatus. Meanwhile, the water dispensing apparatus further comprises a spray control member for controlling shifting different water spraying patterns of the water dispensing apparatus. In other words, the user must individually operate the valve control and the spray control for different operations of the water dispensing apparatus.

Therefore, the present invention solves the existing problems of the water dispensing apparatus, wherein the control of the present invention requires a single operation action not only for switching on-and-off the water dispensing apparatus but also for controllably shifting different water spraying patterns, such that the user is able to easily control different operations of the water dispensing apparatus in a one hand operatable manner.

SUMMARY OF THE PRESENT INVENTION

The invention is advantageous in that it provides a water dispensing apparatus of the present invention adapted for connecting to a water source via a water hose for guiding the water to spray or irrigate. In particular, the water dispensing apparatus of the present invention provides different water spraying patterns. According to the present invention, the foregoing and other objects and advantages are attained by a water dispensing apparatus, comprising a dispensing body. The dispensing body has a handle portion, a guiding portion, and an extension portion integrally extended between the handle portion and the guiding portion. The dispensing body further has an inlet channel provided at the handle portion for connecting to a water source, and an outlet channel provided at the guiding portion for guiding water to flow from the inlet channel to the outlet channel. The dispensing body further comprises a receiving cavity provided at the extension portion, wherein the receiving cavity has a water inlet end communicatively linked to the inlet channel and a water outlet end communicatively linked to the outlet channel.

The dispensing body further comprises a nozzle and a nozzle cavity formed at the guiding portion to receive the nozzle in the nozzle cavity so as to communicatively link to the front opening end of the outlet channel. Accordingly, the diameter size of the nozzle cavity is larger than that of the nozzle.

The water dispensing apparatus further comprises a control valve movably disposed in the receiving cavity at the extension portion, a control unit arranged for being actuated manually, and an actuation member. The control unit is operated in response to the actuation member to synchronizingly actuate the control valve. The control unit has a first controlling side and a second controlling side. The control valve comprises a first wheel axle and a second wheel axle. The control valve further has a water sealing member and a pusher member. The control valve is driven to rotate within the receiving cavity by the control unit. The actuation member has a front actuating end extended toward the nozzle cavity, a rear actuating end, and a guiding slot formed at the rear actuating end, wherein the pusher member is slidably engaged with the guiding slot. When the control unit is actuated manually to drive the control valve to rotate correspondingly, the actuation member is driven to move back-and-forth. By driving the head portion of the actuation member at the different locations that the head portion enters into the receiving cavity, enters into the nozzle, or withdraws from the receiving cavity, the user can selectively operate the water dispensing apparatus not only for switching on-and-off the control valve but also for controllably shifting different water spraying patterns of the nozzle via a single continuous action of the control unit.

These and other objectives, features, and advantages of the present invention will become apparent from the following detailed description, the accompanying drawings, and the appended claims.

DETAILED DESCRIPTION OF THE PREFERRED EMBODIMENT

Figure 1:
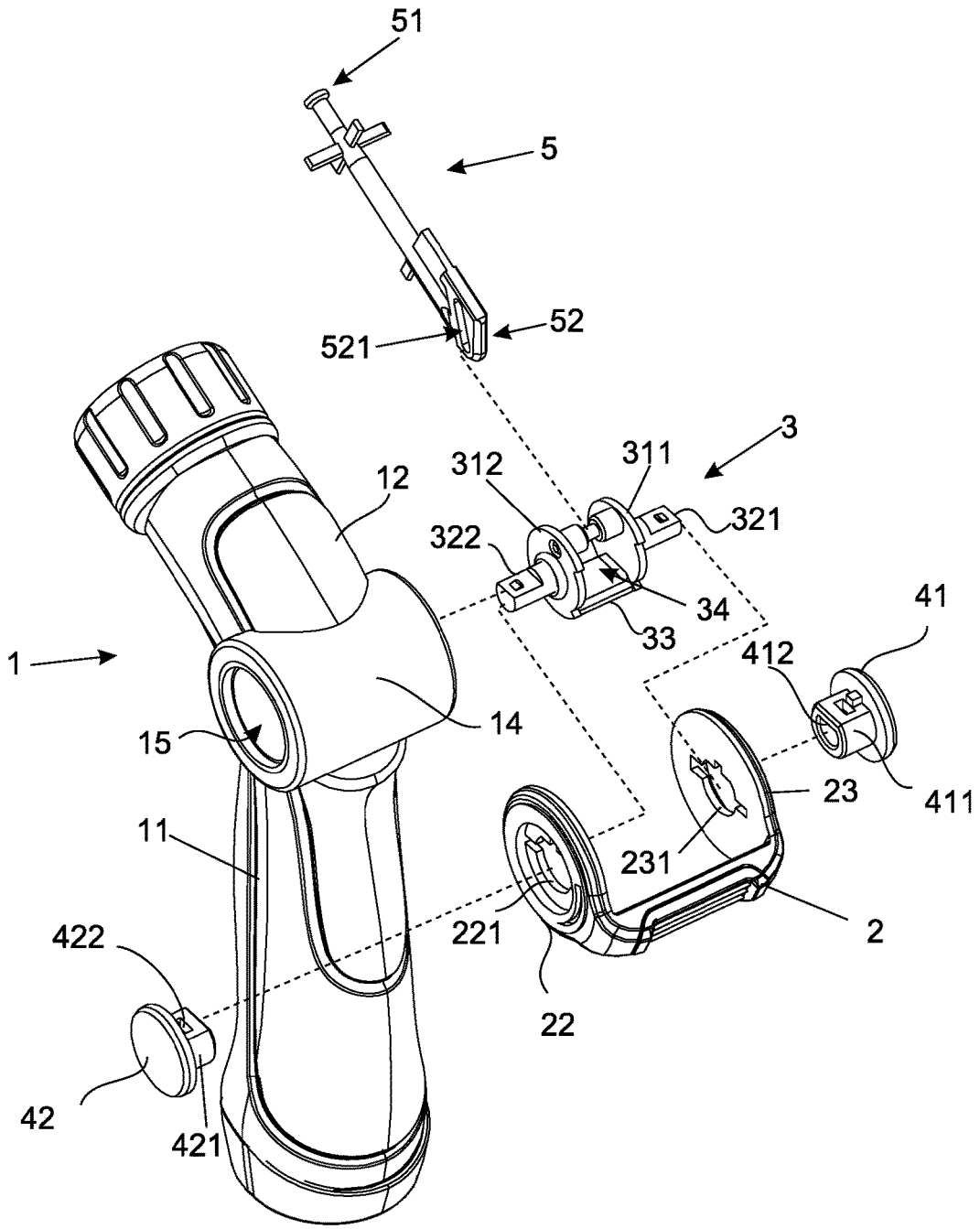
FIG. 1 is an exploded perspective view of a water dispensing apparatus according to a preferred embodiment of the present invention.
Figure 2:
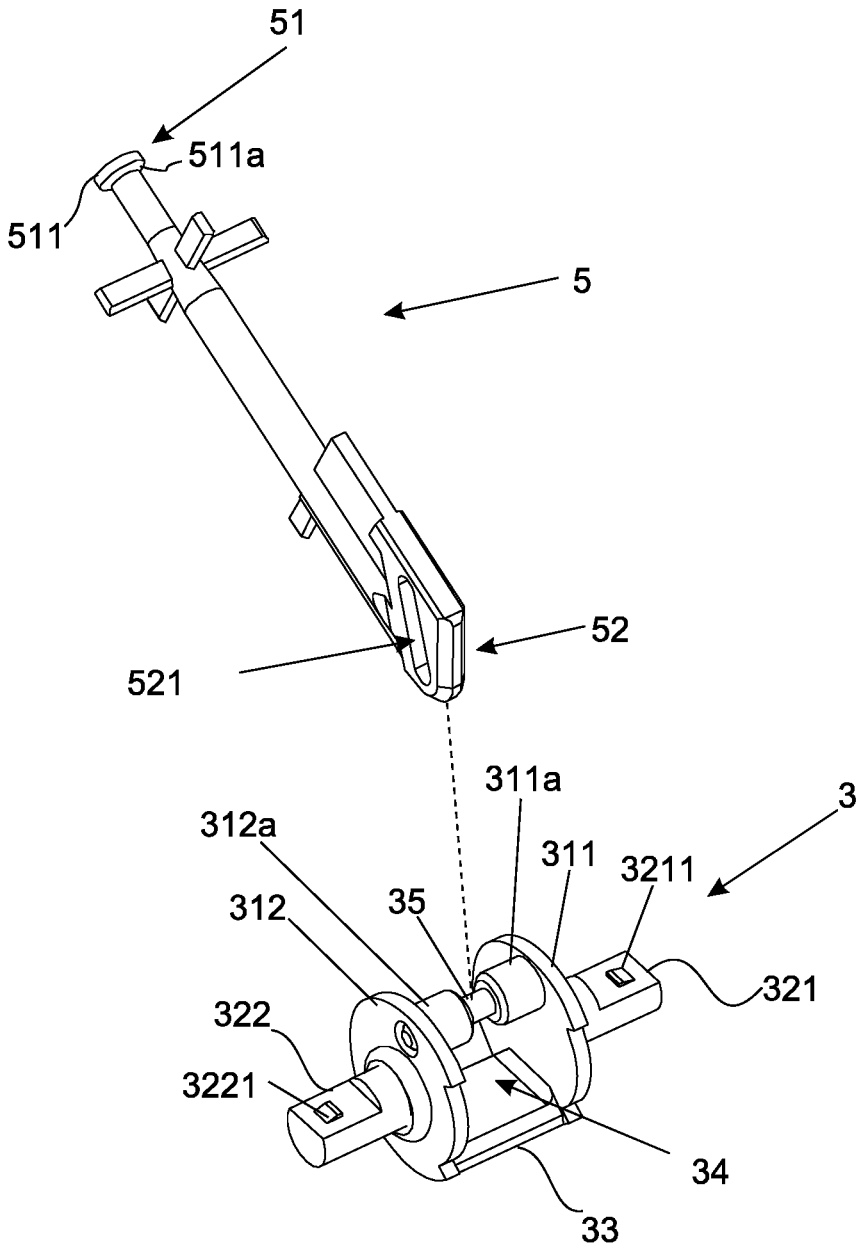
FIG. 2 is an enlarged perspective view of a control of the water dispensing apparatus according to the above preferred embodiment of the present invention.
Figure 3:
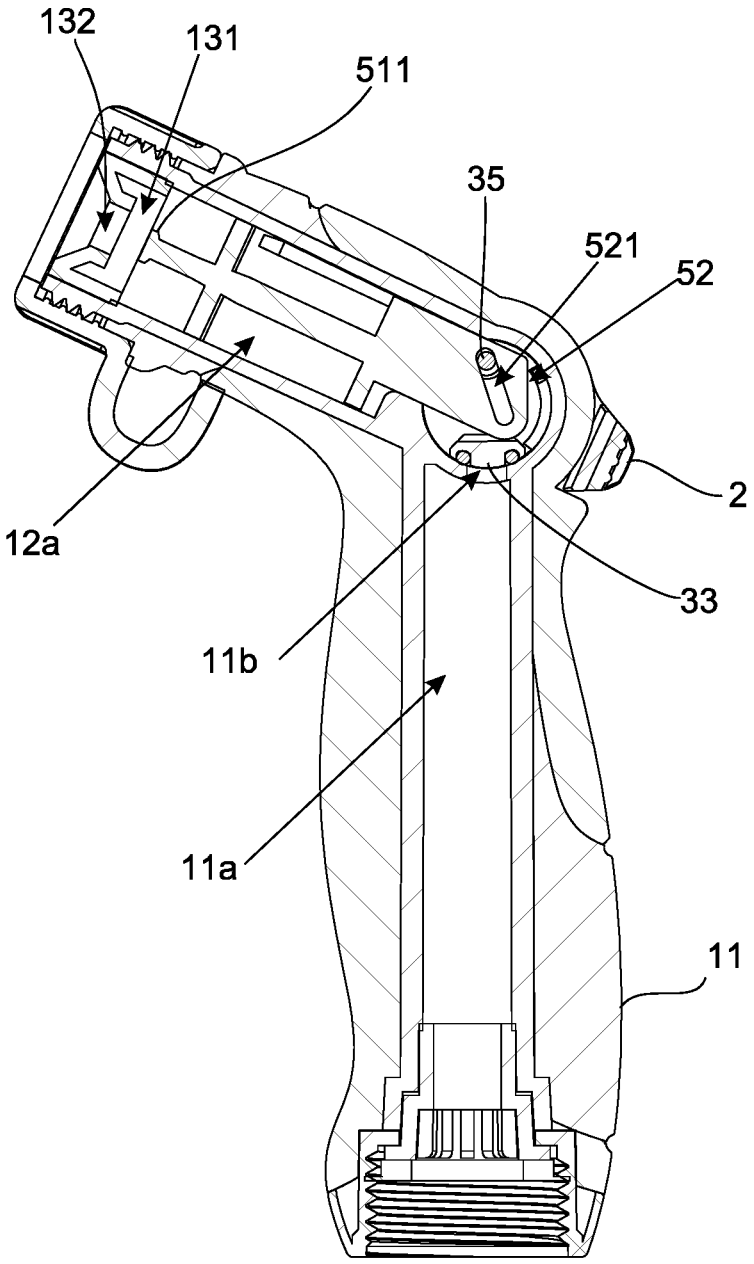
FIG. 3 is a sectional view of the water dispensing apparatus according to the above preferred embodiment of the present invention.
Figure 4:
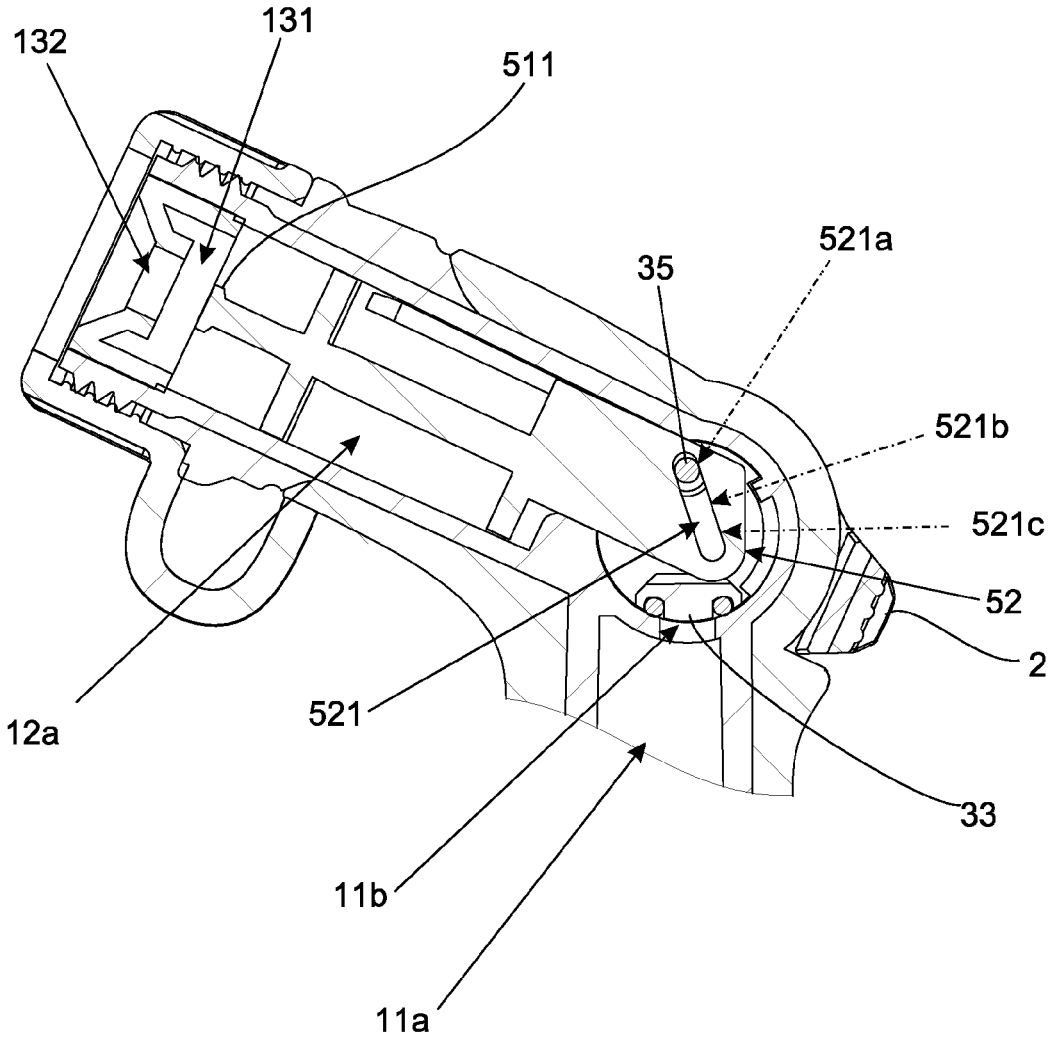
FIG. 4 is a partially sectional view of the water dispensing apparatus according to the above preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

With the aids of the Figures shown below, the content of techniques, features, and embodiments of the present invention is herein described, so as for the examiners to further understand the present invention.

In order for well understanding of the present invention, the following will provide preferred embodiments and corresponding figures for detail descriptions. Corresponding figures of the preferred embodiments of the present invention will also be applied for further illustration, so as to help those who skill in the art to implement the present invention based on the present specification, which however shall not be used to limit the scope of the present invention.

Referring to FIGS. 1 to 7 of the drawings, a water dispensing apparatus according to a preferred embodiment of the present invention is illustrated, wherein the water dispensing apparatus comprises a dispensing body 1 having a handle portion 11, a guiding portion 12, and an extension portion 14 integrally extended between the handle portion 11 and the guiding portion 12. Preferably, the extension portion 14 is an angled portion, such that the guiding portion 12 is angularly extended from the handle portion 11. The dispensing body 1 further has an inlet channel 11*a* provided at the handle portion 11 for connecting to a water source, and an outlet channel 12*a* provided at the guiding portion 12 for guiding water to flow from the inlet channel 11*a* to the outlet channel 12*a*. The dispensing body 1 further comprises a water nozzle 132 coupled at the outlet channel 12*a* at a front opening end thereof. The dispensing body 1 further comprises a receiving cavity 15 provided at the extension portion 14, wherein the receiving cavity 15 has a water inlet end 11*b* communicatively linked to the inlet channel 11*a* and a water outlet end 12*b* communicatively linked to the outlet channel 12*a*, such that the water can pass through the receiving cavity 15 from the inlet channel 11*a* to the outlet channel 12*a*. The dispensing body 1 further has a nozzle cavity 131 formed at the guiding portion 12 to receive the nozzle 132 in the nozzle cavity 131 so as to communicatively link to the front opening end of the outlet channel 12*a*. Accordingly, the diameter size of the nozzle cavity 131 is larger than that of the nozzle 132.

The water dispensing apparatus further comprises a control valve 3 movably disposed in the receiving cavity 15 at the extension portion 14, a control unit 2, and an actuation member 5. The control unit 2 is operated in response to the actuation member 5 to synchronizingly actuate the control valve 3. The control unit 2 has a first controlling side 22 and a second controlling side 23. The control unit 2 further has a first hole 221 formed at the first controlling side 22 and a second hole 231 formed at the second controlling side 23. In particular, the control valve 3 is rotatably disposed in the receiving cavity 15 and is arranged to be driven to rotate by the actuation member 5. The control valve 3 comprises a first side wheel 311 and a second side wheel 312 extended parallelly with each other. The control valve 3 further comprises a first wheel axle 321 outwardly and coaxially extended from an outer side of the first side wheel 311, and a second wheel axle 322 outwardly and coaxially extended from an outer side of the second side wheel 312. The control valve 3 further comprises a first sleeve member 311*a* outwardly and eccentrically extended from an inner side of the first side wheel 311, and a second sleeve member 312*a* outwardly and eccentrically extended from an inner side of the second side wheel 312, wherein the first sleeve member 311*a* and the second sleeve member 312*a* are spacedly aligned with each other end-to-end. The control valve 3 further has a water sealing member 33, a pusher member 35, and a valve opening portion 34, which are provided between the first side wheel 311 and the second side wheel 312. Accordingly, the water sealing member 33 has a curved planar configuration extended between peripheral edge portions of the first side wheel 311 and the second side wheel 312. The pusher member 35 is eccentrically extended between the first side wheel 311 and the second side wheel 312, wherein the pusher member 35 is located opposite to the water sealing member 33. Preferably, the pusher member 35 is extended between the first sleeve member 311*a* and the second sleeve member 312*a*. The valve opening portion 24 is defined at a space between the first side wheel 311 and the second side wheel 312 and at a space between the water sealing member 33 and the pusher member 35. Preferably, the pusher member 35 has an elongated rod shape that two ends of the pusher member 35 are coupled at the first side wheel 311 and the second side wheel 312 respectively. Accordingly, the first wheel axle 321 has a first protruding portion 3211 integrally protruded from an circumferential surface thereof, and the second wheel axle 322 has a second protruding portion 3221 integrally protruded from an circumferential surface thereof. The shape of the water sealing member 33 is configured to match with the water inlet 11*b* that the size of the water sealing member 33 is larger than an opening size of the water inlet 11*b*, such that when the control valve 3 is actuated to move the water sealing member 33 at the water inlet 11*b*, the water sealing member 33 can water-seal the water inlet 11*b* to block the water therefrom.

The actuation member 5 is movably extended along the outlet channel 12*a*. The actuation member 5 has a front actuating end 51, a rear actuating end 52, and an enlarged head portion 511 defined at the front actuating end 51, wherein the head portion 511 has a face surface 511*a* defined thereat. Accordingly, the actuation member 5 has an elongated body rearwardly extended from the rear face surface

511*a* and an enlarged flat body frontwardly extended from the rear actuating end 52 to the elongated body. The size of the head portion 511 is larger than a diameter size of the elongated body. The flat body has a planar configuration defining two flat enlarged side surfaces. The actuation member 5 further has an inclined guiding slot 521 formed at the rear actuating end 52 on the flat body, wherein the pusher member 35 is extended through the inclined guiding slot 521. Preferably, the inclined guiding slot 521 is a straight elongated slot. In other words, the inclined guiding slot 521 is a through slot formed on the flat body, such that the pusher member 35 can pass from one flat enlarged side surface of the flat body to the other through the inclined guiding slot 521. The front actuating end 51 of the actuation member 5 is extended close to the nozzle cavity 131. A width of the front actuating end 51 of the actuation member 5 is smaller than a bore size of the nozzle cavity 131 and that of the nozzle 132. The rear actuating end 52 of the actuation member 5 is coupled at the pusher member 35 via the inclined guiding slot 521. The front actuating end 51 of the actuation member 5 is extended at a direction of the outlet channel 12*a* to the nozzle 132. The rear actuating end 52 of the actuation member 5 is extended at a direction of the outlet channel 12*a* to the control valve 3. It is worth mentioning that the pusher member 35 is driven to slide along the inclined guiding slot 521 to move the actuation member 5.

For better understanding the sliding movement of the pusher member 35 along the inclined guiding slot 521 to reciprocatingly move the actuation member 5, the inclined guiding slot 521 defines a first guiding region 521*a* at one end of the inclined guiding slot 521, a second guiding region 521*b*, and a third guiding region 521*c* at an opposed end of the inclined guiding slot 521, wherein the second guiding region 521*b* is formed between the first guiding region 521*a* and the third guiding region 521*c*.

Besides, the location of the pusher member 35 moved at either the first guiding region 521*a*, the second guiding region 521*b*, or the third guiding region 521*c* only illustrates the sliding movement of the pusher member 35 as an example, wherein the configurations of the first guiding region 521*a*, the second guiding region 521*b*, and the third guiding region 521*c* should not be limited according to the present invention.

The water dispensing apparatus further comprises a coupling unit for coupling the control unit 2 with the control valve 3. The coupling unit comprises a first coupling cap 41, a second coupling cap 42, a first coupling shaft 411 extended from the first coupling cap 41, and a second coupling shaft 421 extended from the second coupling cap 42. The coupling unit further has a first engaging slot 412 formed at the first coupling shaft 411 and a second engaging slot 422 formed at the second coupling shaft 421.

The assembling structure of the water dispensing apparatus is shown as follows. The actuation member 5 is placed at the outlet channel 12*a* at a position that the rear actuating end 52 of the actuation member 5 is extended into the receiving cavity 15 of the extension portion 14. The control valve 3 is disposed in the receiving cavity 15 of the extension portion 14, wherein the pusher member 35 is passed through the inclined guiding slot 521 at the rear actuating end 52 of the actuation member 5. Then, the first side wheel 311 and the second side wheel 312 are coupled with each other to couple the pusher member 35 between the first sleeve member 311*a* and the second sleeve member 312*a*. The first wheel axle 321 and the second wheel axle 322 are extended through the first hole 221 of the first controlling side 22 of the control unit 2 and the second hole 231 of the second controlling side 23 thereof respectively. Therefore, the first coupling shaft 411 is coupled at the first wheel axle 321 to sandwich the first controlling side 22 of the control unit 2 between the first coupling cap 41 and the first side wheel 311, while the second coupling shaft 421 is coupled at the second wheel axle 322 to sandwich the second controlling side 23 of the control unit 2 between the second coupling cap 42 and the second side wheel 312. Therefore, the first protruding portion 3211 of the first wheel axle 321 is engaged with the first engaging slot 412 while the second protruding portion 3221 of the second side wheel 322 is engaged with the second engaging slot 422 to lock up the control valve 3, the control unit 2, and the actuation member 5 with each other so as to complete the assembling operation of the present invention.

The operation of water dispensing apparatus is shown as follows. When the control valve 3 is driven to rotate, the pusher member 35 is moved correspondingly. In particular, since the pusher member 35 is eccentrically coupled at the control valve, the pusher member 35 is driven to rotate about the center of the control valve 3 at a position that the reciprocatingly moving path of the pusher member 35 is a pendulum path. The sliding movement of the pusher member 35 is restricted by the length of the inclined guiding slot 521. When the control unit 2 is actuated to move, the control valve 3 is driven to rotate correspondingly for driving the pusher member 35 to slide along the inclined guiding slot 521. Since the inclined guiding slot 521 is forwardly inclined to the front actuating end 51 of the actuation member 5, the pusher member 35 is slid along the inclined guiding slot 521 to move the actuating member 5 back-and-forth. In addition, the inclination of the inclined guiding slot 521 can also temporarily retain the actuation member 5 at a desired position by temporarily holding the pusher member 35 at one position of the inclined guiding slot 521.

Figure 5:
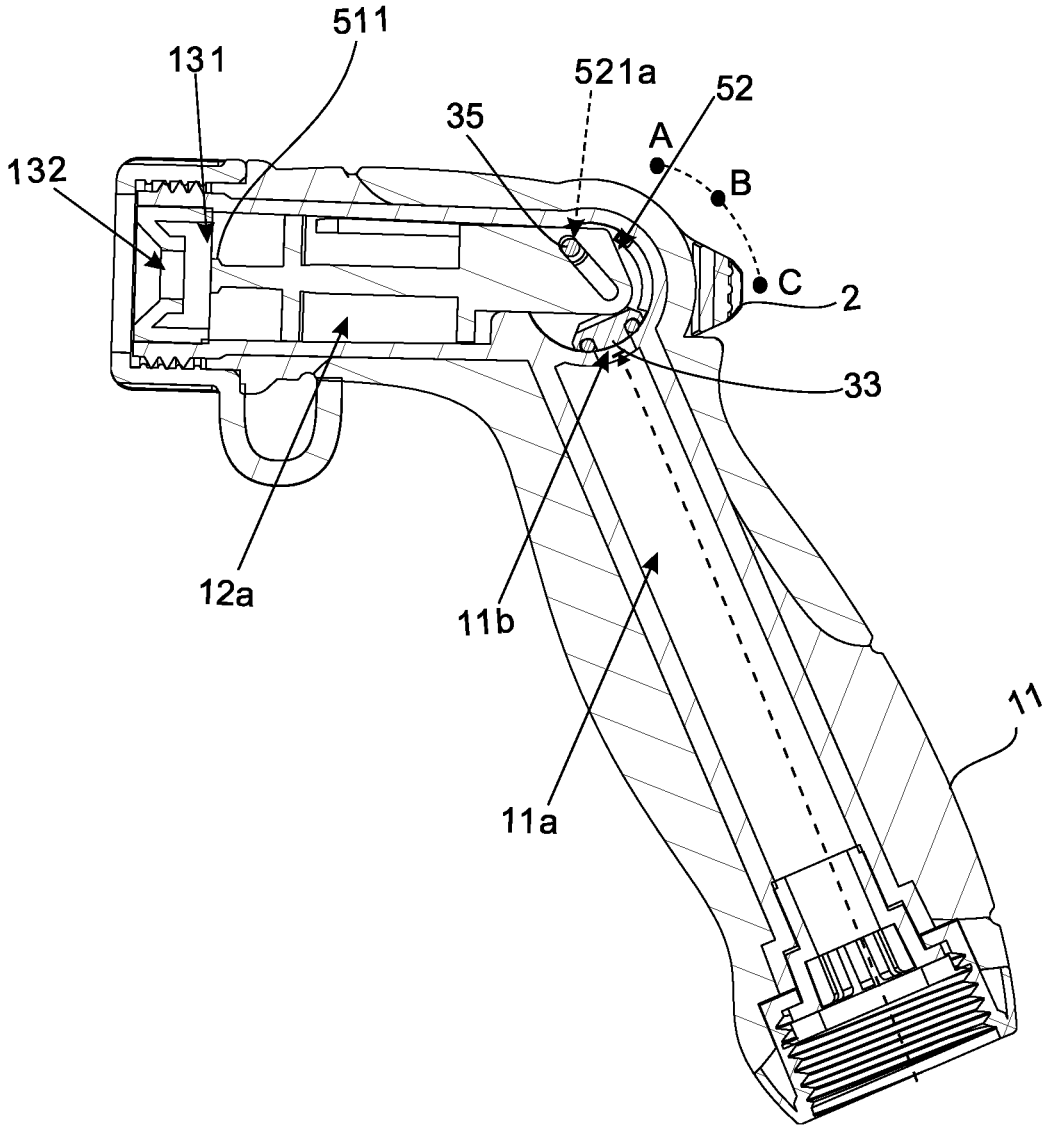
FIG. 5 is a sectional view of the water dispensing apparatus according to the above preferred embodiment of the present invention, illustrating the actuation member at a first position.
Figure 6:
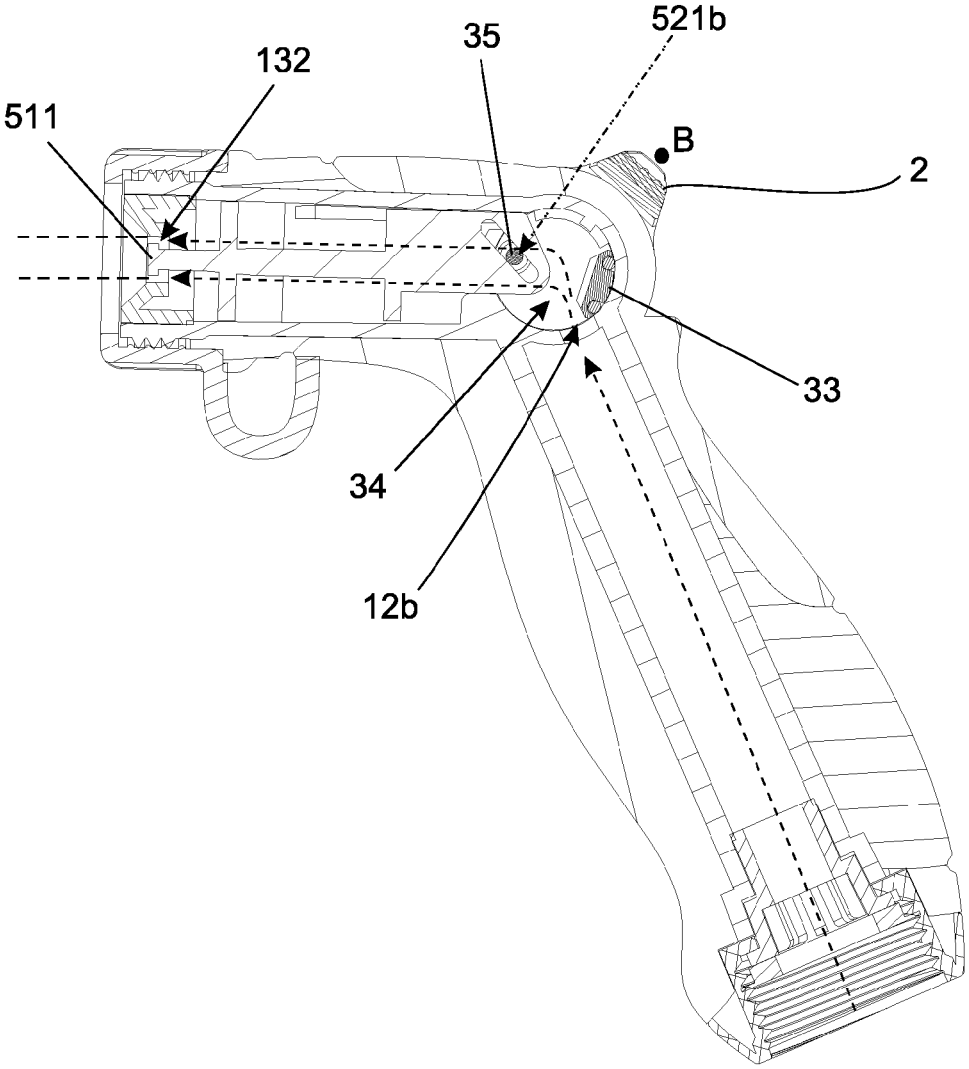
FIG. 6 is a sectional view of the water dispensing apparatus according to the above preferred embodiment of the present invention, illustrating the actuation member at a second position.
Figure 7:
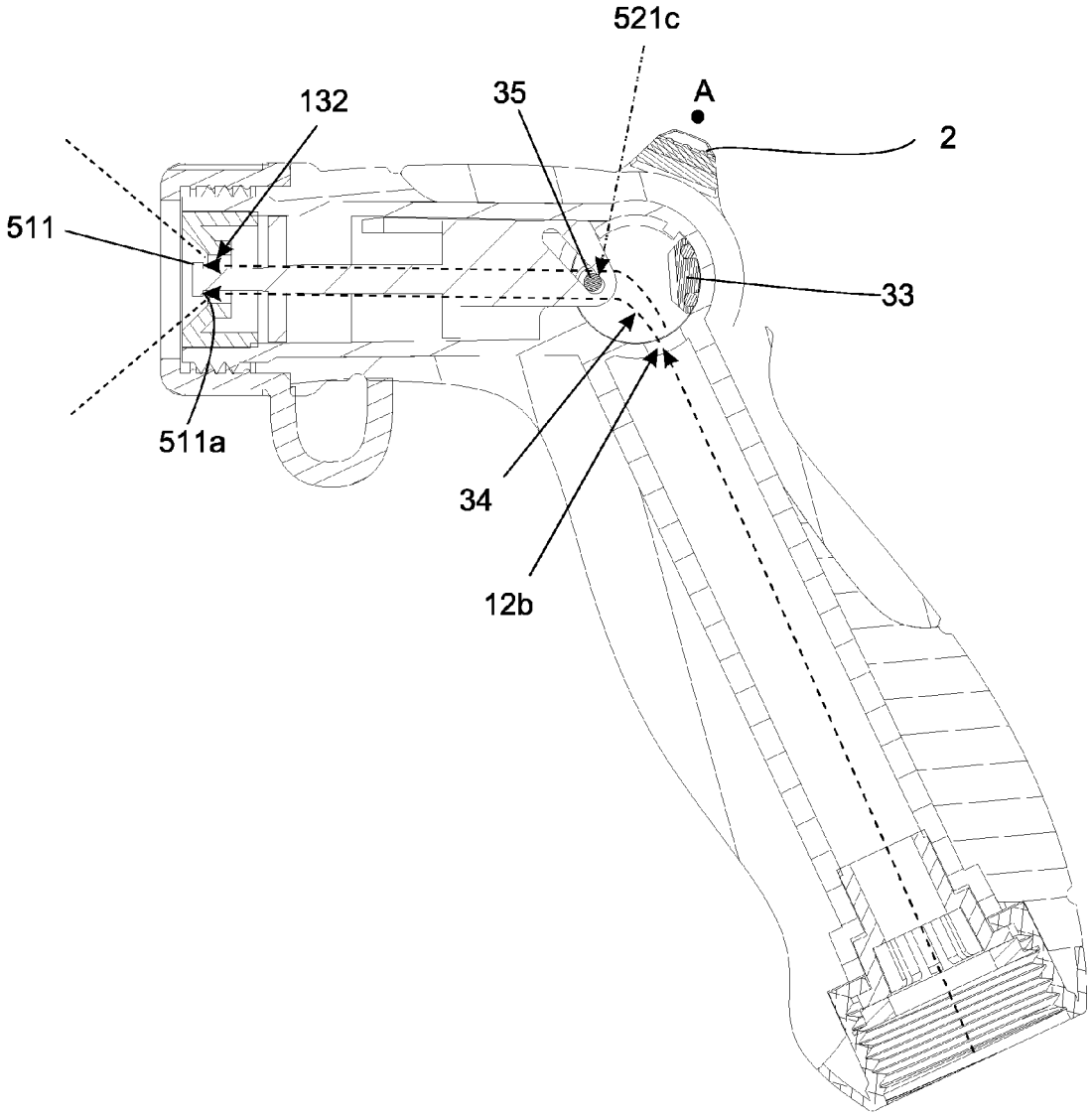
FIG. 7 is a sectional view of the water dispensing apparatus according to the above preferred embodiment of the present invention, illustrating the actuation member at a third position.

FIGS. 5 to 7 illustrate the water dispensing apparatus between a closed position and an opened position. For better understanding, the moving path of the control unit 2 is defined with a point A, point B, and a point C. As shown in FIG. 5, when the control unit is manually moved at the point C, the control valve 3 is driven to move correspondingly at a position that the pusher member 35 is slid at the first guiding region 521*a* of the inclined guiding slot 521. As a result, the actuation member 5 is driven backward to move the head portion 511 thereof backwardly away from the nozzle cavity 131 or at the rear portion of the nozzle cavity 131. At the same time, the sealing member 33 of the control valve 3 is moved to seal and close the water inlet 11*b* so as to switch off the water dispensing apparatus.

As shown in FIG. 6, when the control unit is manually moved from the point C to the point B, the control valve 3 is driven to move correspondingly at a position that the pusher member 35 is slid from the first guiding region 521*a* of the inclined guiding slot 521 to the second guiding region 521*b*. As a result, the actuation member 5 is driven forward to move the head portion 511 thereof forwardly to the nozzle 132. Accordingly, the head portion 511 of the actuation member 5 is spaced apart from an inner rim of the nozzle 132 to define a gap therebetween. In particular, a front edge of the head portion 511 of the actuation member 5 is aligned with the front rim of the nozzle 132 at the same horizontal level. At the same time, the water inlet 11*b* is partially covered by the sealing member 33 of the control valve 3, such that a portion of the water inlet 11*b* is sealed and blocked by the sealing member 33 of the control valve 3 while a portion of the water inlet 11*b* is communicated with the valve opening portion 34 of the control valve 3. Therefore, the water will guide to pass from the water inlet 11*b* to the valve opening portion 34, to the nozzle cavity 131, and to the nozzle 132 consequently. The water is then guided to spray out of the water dispensing apparatus through the gap between the head portion 511 of the actuation member 5 and the nozzle 132. Accordingly, the water is guided to spray in a straight spraying mode. It is worth mentioning that when the head portion 511 of the actuation member 5 is moved within the nozzle 132, the water is still guided to spray in the straight spraying mode with a relatively larger volume of water. It is because the sealing member 33 of the control valve 3 is moved to fully open up the water inlet 11*b* when the head portion 511 of the actuation member 5 is moved within the nozzle 132.

As shown in FIG. 7, when the control unit is manually moved from the point B to the point C, the control valve 3 is driven to move correspondingly at a position that the pusher member 35 is slid from the second guiding region 521*b* of the inclined guiding slot 521 to the third guiding region 521*c*. As a result, the actuation member 5 is driven forward to move the head portion 511 thereof into the nozzle 132. In particular, the head portion 511 of the actuation member 5 is extended through the nozzle 132 to a front end thereof. At the same time, the sealing member 33 of the control valve 3 is already moved to fully open up the water inlet 11*b*, such that the water inlet 11*b* is in a fully opened condition. Therefore, the water is guided to pass from the inlet channel 11*a* to the water inlet 11*b*, to the valve opening portion 34, to the outlet channel 12*a*, and to the nozzle cavity 131 consequently. Accordingly, the flowing direction of the water will hit the rear face surface 511*a* of the head portion 511 of the actuation member 5, such that the water is then be radially diffused and sprayed out of the nozzle 132. Accordingly, the water is guided to spray in a radial spraying mode.

It is worth mentioning that the user is able to move the control unit 2 at any point between the point A and the point B, or between the point B to the point C to selectively adjust the water volume for the spraying operation. In other words, the user is able to switch on-and-off the control valve 3 and to selectively shift different spraying patterns with different water volumes via the single continuous action of the control unit 2 between the point A and the point C.

As shown in FIGS. 8 to 12, a water dispensing apparatus according to a second embodiment illustrates an alternative mode of the inclined guiding slot 521. The control unit 2 is manually actuated to drive the control valve 3 to move concurrently. The sealing member 33 is formed at the peripheral edge of the control valve 3. The pusher member 35 is eccentrically provided at the control valve 3. The valve opening portion 34 is defined within the control valve 3 between the pusher member 35 and the sealing member 33. The shape of the water sealing member 33 is configured to match with the water inlet 11*b* that the size of the water sealing member 33 is larger than an opening size of the water inlet 11*b*, such that when the control valve 3 is actuated to move the water sealing member 33 at the water inlet 11*b*, the water sealing member 33 can water-seal the water inlet 11*b* to block the water therefrom.

Furthermore, the actuation member 5 is movably coupled at the outlet channel 12*a*. The actuation member 5 has a front actuating end 51, a rear actuating end 52, and an enlarged head portion 511 defined at the front actuating end 51, wherein the head portion 511 has a face surface 511*a* defined thereat. Accordingly, the actuation member 5 has an elongated body rearwardly extended from the rear face surface 511*a* and an enlarged flat body frontwardly extended from the rear actuating end 52 to the elongated body. The size of the head portion 511 is larger than a diameter size of the elongated body. The flat body has a planar configuration defining two flat enlarged side surfaces. The inclined guiding slot 521 is formed at the rear actuating end 52 on the flat body and is extended rearwardly, wherein the pusher member 35 is extended through the inclined guiding slot 521. In other words, the inclined guiding slot 521 is a through slot formed on the flat body, such that the pusher member 35 can pass from one flat enlarged side surface of the flat body to the other through the inclined guiding slot 521. The front actuating end 51 of the actuation member 5 is extended close to the nozzle cavity 131. A width of the front actuating end 51 of the actuation member 5 is smaller than a bore size of the nozzle cavity 131 and that of the nozzle 132. The rear actuating end 52 of the actuation member 5 is coupled at the pusher member 35 via the inclined guiding slot 521. The front actuating end 51 of the actuation member 5 is extended at a direction of the outlet channel 12*a* to the nozzle 132. The rear actuating end 52 of the actuation member 5 is extended at a direction of the outlet channel 12*a* to the control valve 3. It is worth mentioning that the pusher member 35 is driven to slide along the inclined guiding slot 521 to move the actuation member 5.

Figure 8:
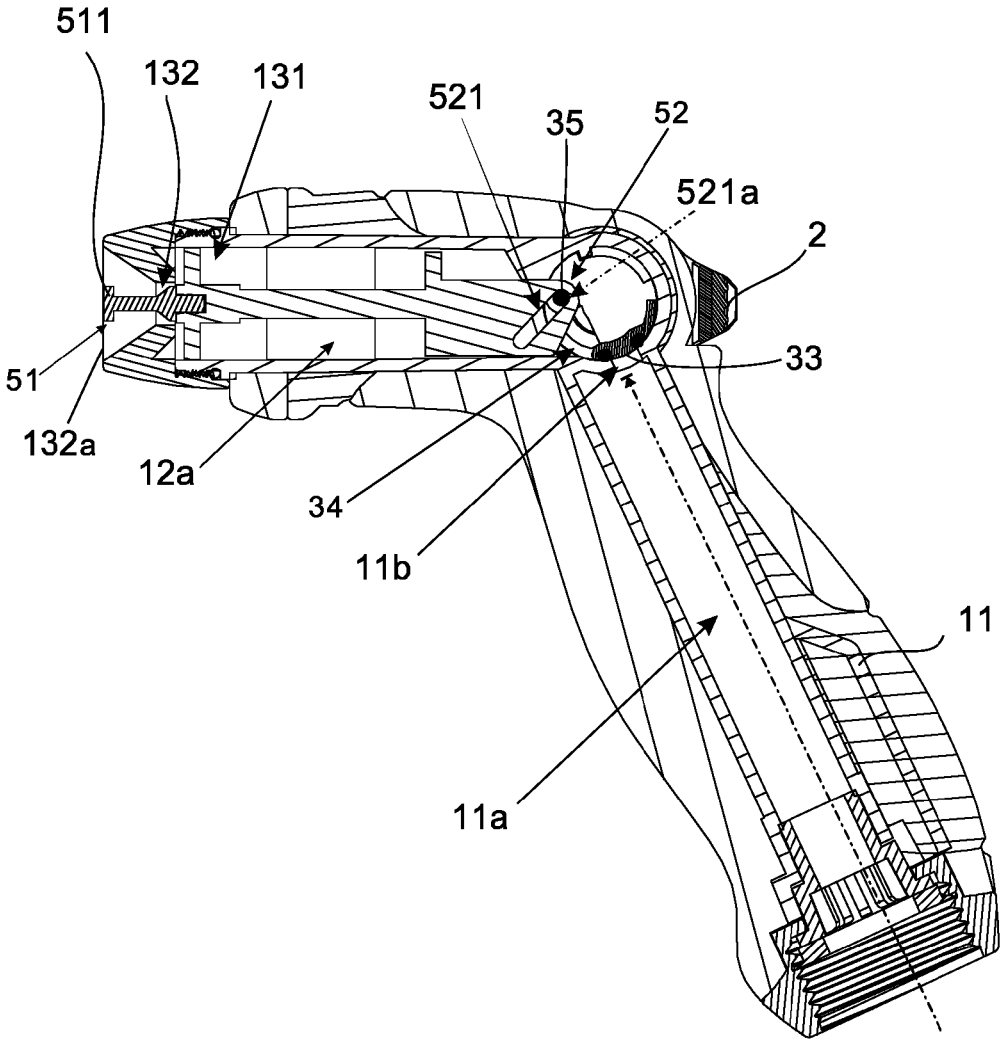
FIG. 8 is a sectional view of the water dispensing apparatus according to a second preferred embodiment of the present invention, illustrating the actuation member at a first position.

For better understanding, the inclined guiding slot 521 defines a first guiding region 521*a* at one end of the inclined guiding slot 521, a second guiding region 521*b*, a third guiding region 521*c*, and a fourth guiding region 521*d* at an opposed end of the inclined guiding slot 521, wherein the second and third guiding regions 521*b*, 521*c* are formed between the first guiding region 521*a* and the fourth guiding region 521*d*. As shown in FIG. 8, when the actuation member 5 is moved forwardly to enter into the nozzle 132, the head portion 511 of the actuation member 5 is frontwardly protruded from the front side of the nozzle 132 at a position that the head portion 511 of the actuation member 5 is close to the front rim 132*a* of the nozzle 132. At the same time, the sealing member 33 of the control valve 3 is moved to seal and close the water inlet 11*b* so as to switch off the water dispensing apparatus. It is worth mentioning that the pusher member 35 is moved at the first guiding region 521*a* of the inclined guiding slot 521 as shown in FIG. 8.

Figure 9:
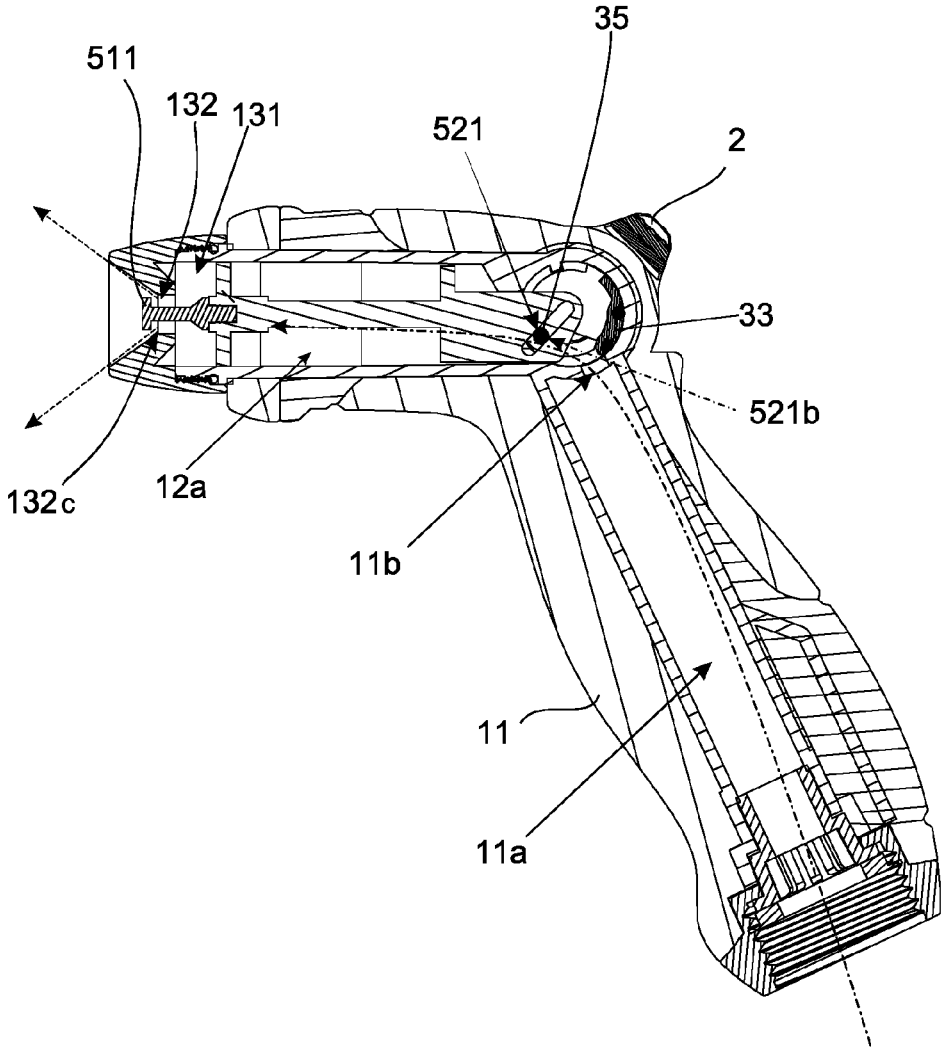
FIG. 9 is a sectional view of the water dispensing apparatus according to the second preferred embodiment of the present invention, illustrating the actuation member at a second position.

As shown in FIG. 9, when the control unit 2 is actuated to slide the pusher member 35 from the first guiding region 521*a* of the inclined guiding slot 521 to the second guiding region 521*b*, the actuation member 5 is driven backward to move the head portion 511 thereof backwardly from the nozzle 132 at a position that the head portion 511 of the actuation member 5 is close to a nozzle channel 132*c* of the nozzle 132. Accordingly, a gap is formed between the head portion 511 of the actuation member 5 and the front rim of the nozzle 132. At the same time, the water inlet 11*b* is partially covered by the sealing member 33 of the control valve 3, such that a relatively small portion of the water inlet 11*b* is sealed and blocked by the sealing member 33 of the control valve 3 while a relatively large portion of the water inlet 11*b* is communicated with the valve opening portion 34 of the control valve 3 to increase the water volume to enter into the valve opening portion 34. Therefore, relatively large volume of water is guided to flow from the inlet channel 11*a*, to the valve opening portion 34, to the outlet channel 12*a*, and to the nozzle cavity 131 consequently. Accordingly, the water is guided to spray in a large radial spraying mode.

Figure 10:
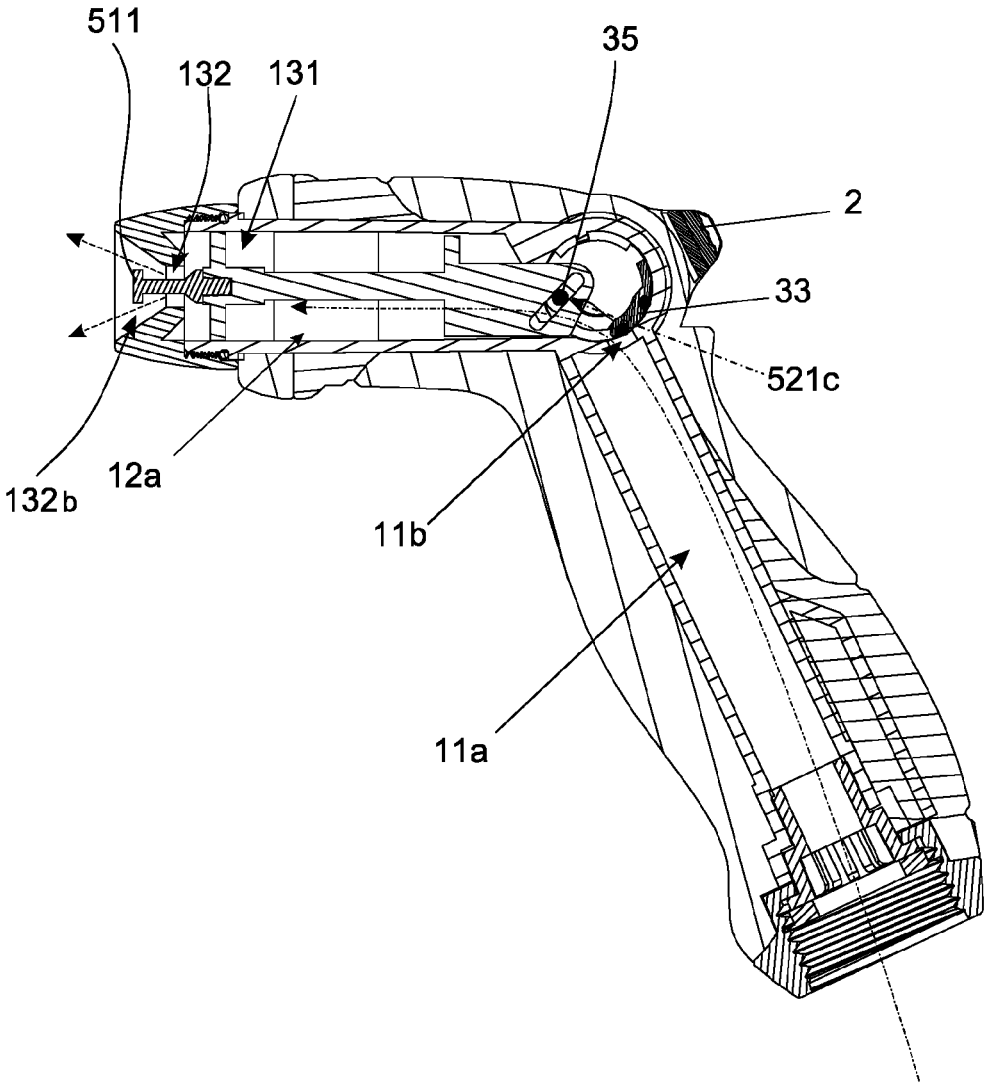
FIG. 10 is a sectional view of the water dispensing apparatus according to the second preferred embodiment of the present invention, illustrating the actuation member at a third position.

As shown in FIG. 10, when the control unit 2 is actuated to slide the pusher member 35 to the third guiding region 521*c* of the inclined guiding slot 521, the actuation member 5 is driven backward to move the head portion 511 thereof backwardly from the nozzle 132 at a position that the head portion 511 of the actuation member 5 is located at a mid section 132*b* of the nozzle 132. The mid section 132*b* of the nozzle 132 is defined between the front rim 132*a* of the nozzle 132 and the nozzle channel 132*c* of the nozzle 132. At the same time, the water inlet 11*b* is partially covered by the sealing member 33 of the control valve 3, such that a relatively large portion of the water inlet 11*b* is sealed and blocked by the sealing member 33 of the control valve 3 while a relatively small portion of the water inlet 11*b* is communicated with the valve opening portion 34 of the control valve 3 to reduce the water volume to enter into the valve opening portion 34. Therefore, relatively small volume of water is guided to flow from the inlet channel 11*a*, to the valve opening portion 34, to the outlet channel 12*a*, and to the nozzle cavity 131 consequently. Accordingly, the water is guided to spray in a small radial spraying mode.

Figure 11:
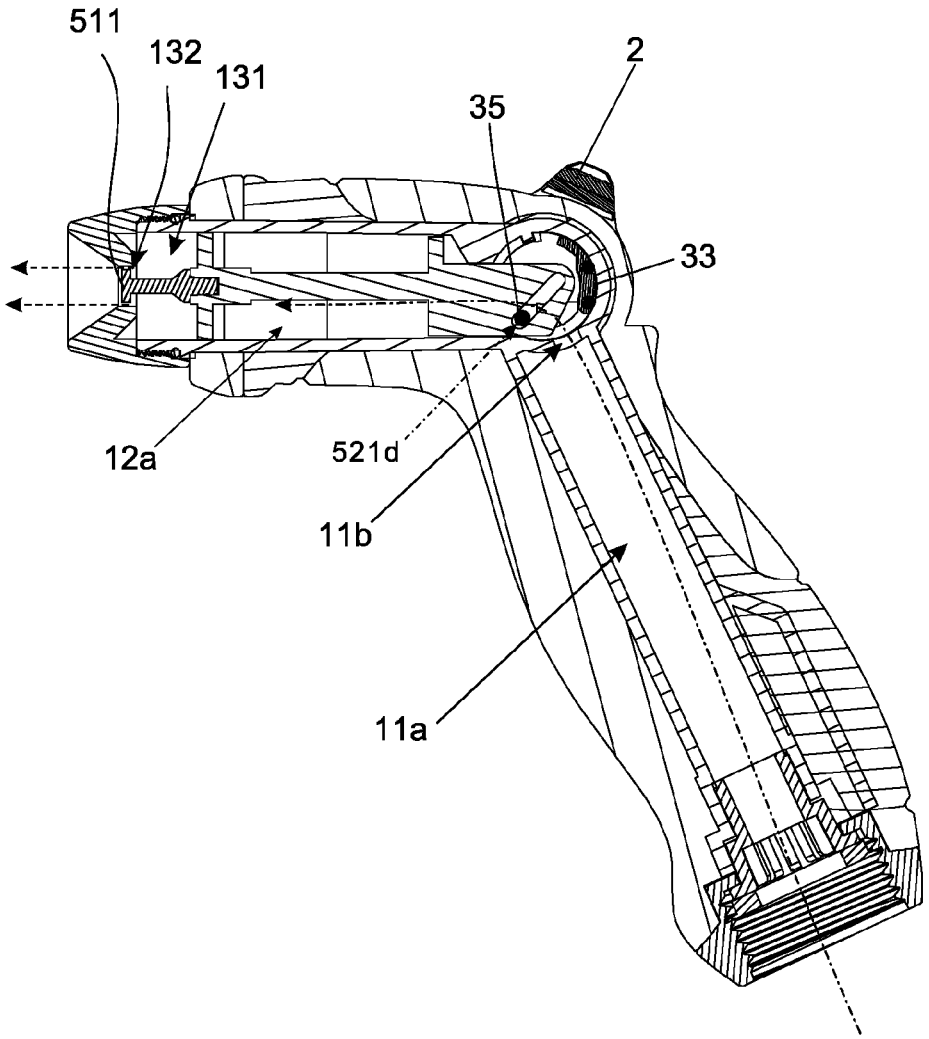
FIG. 11 is a sectional view of the water dispensing apparatus according to the second preferred embodiment of the present invention, illustrating the actuation member at a fourth position.
Figure 12:
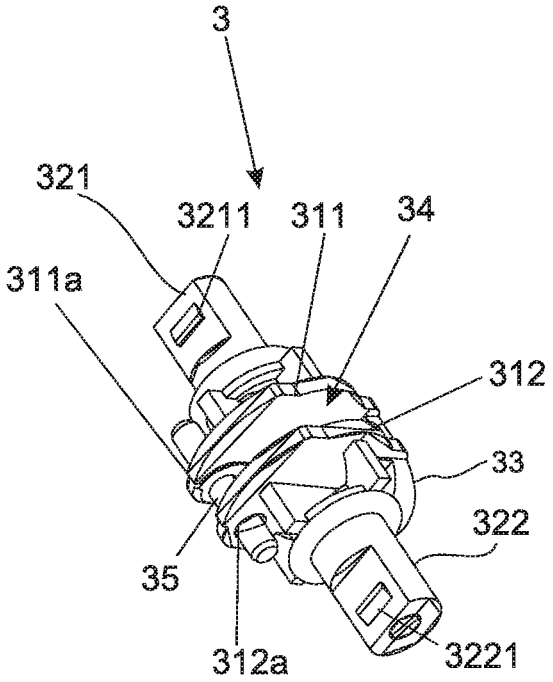
FIG. 12 is an enlarged perspective view of a control valve according to the second preferred embodiment of the present invention.

As shown in FIG. 11, when the control unit 2 is actuated to slide the pusher member 35 to the fourth guiding region 521*d* of the inclined guiding slot 521, the actuation member 5 is driven backward to move the head portion 511 thereof backwardly from the nozzle 132 at a position that the head portion 511 of the actuation member 5 is moved into the nozzle channel 132*c* of the nozzle 132. In other words, the head portion 511 of the actuation member 5 is not protruded out of the nozzle channel 132*c* of the nozzle 132. At the same time, the sealing member 33 of the control valve 3 is already moved to fully open up the water inlet 11*b*, such that the water inlet 11*b* is in a fully opened condition. Therefore, the water is guided to flow from the inlet channel 11*a*, to the valve opening portion 34, to the outlet channel 12*a*, and to the nozzle cavity 131 consequently. The water is then guided to spray out of the water dispensing apparatus through the gap between the head portion 511 of the actuation member 5 and the nozzle 132. Accordingly, the water is guided to spray in a straight spraying mode.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A water dispensing apparatus, comprising:

a dispensing body having a guiding portion and an extension portion extended from said guiding portion, wherein said dispensing body further comprises a nozzle provided at an end of said guiding portion; and a water control, which comprises:

a control valve movably disposed in said extension portion of said dispensing body, wherein said control valve comprises a water sealing member and a pusher member located eccentrically to a center of said control valve;

an actuation member supported at said guiding portion, wherein said actuation member has a guiding slot formed at a rear end of said actuation member, wherein said pusher member is slidably engaged with said guiding slot, such that said pusher member is adapted to slide along said guiding slot; and a control unit coupled to said control valve to drive said control valve to rotate within said extension portion of said dispensing body;

wherein when said control valve is driven to rotate, said pusher member is slid along said guiding slot to reciprocatingly move said actuation member at different locations of said nozzle not only for switching on-and-off said control valve but also for controllably shifting different water spraying patterns of said nozzle.

2. The water dispensing apparatus, as recited in claim 1, wherein said water sealing member is formed at a peripheral edge portion of said control valve at a position opposite to said pusher member to define a valve opening portion between said water sealing member and said pusher member.

3. The water dispensing apparatus, as recited in claim 1, wherein said pusher member has a rod shape.

4. A water dispensing apparatus, comprising:

a dispensing body having a guiding portion and an extension portion extended from said guiding portion, wherein said dispensing body further comprises a nozzle provided at an end of said guiding portion; and a water control, which comprises:

a control valve movably disposed in said extension portion of said dispensing body, wherein said control valve comprises a water sealing member and a pusher member located eccentrically to a center of said control valve;

an actuation member supported at said guiding portion, wherein said actuation member has a guiding slot formed at a rear end of said actuation member, wherein said pusher member is slidably engaged with said guiding slot, such that said pusher member is adapted to slide along said guiding slot; and a control unit coupled to said control valve to drive said control valve to rotate within said extension portion of said dispensing body;

wherein when said control valve is driven to rotate, said pusher member is slid along said guiding slot to reciprocatingly move said actuation member among different locations such that a head portion of said actuation member is moved away from said nozzle, said head portion of said actuation member is moved into said nozzle, or said head portion of said actuation member is moved through said nozzle, whereby through a reciprocating movement of said actuation member and a rotational movement of said control valve, said water control is operated not only for switching on-and-off said control valve but also for controllably shifting different water spraying patterns of said nozzle.

5. A water dispensing apparatus, comprising:

a dispensing body having a handle portion, a guiding portion, an extension portion extended between said handle portion and said guiding portion, an inlet channel provided at said handle portion, a receiving cavity formed at said extension portion, and an outlet channel provided at said guiding portion, wherein said receiving cavity communicates with said inlet channel and said outlet channel, wherein said dispensing body further comprises a nozzle provided at said guiding portion to communicate with said outlet channel;

a control unit having a first controlling side and a second controlling side;

a control valve movably disposed in said receiving cavity, wherein two sides of said control valve are coupled at said first controlling side and said second controlling side of said control unit respectively, wherein said control valve comprises a water sealing member and a pusher member located eccentrically to a center of said control valve; and an actuation member slidably coupled along said outlet channel, wherein said actuation member has a front actuating end, a rear actuating end and an enlarged head portion defined at said front actuating end, wherein said actuation member has an elongated body rearwardly extended from said head portion, wherein said rear actuating end of said actuation member is coupled at said pusher member in such a manner that when said control unit is driven to move, said control valve is rotated correspondingly to reciprocatingly move said actuation member among different locations such that said head portion of said actuation member is moved away from said nozzle, said head portion of said actuation member is moved into said nozzle, or said head portion of said actuation member is moved through said nozzle, whereby through a reciprocating movement of said actuation member and a rotational movement of said control valve, said water dispensing apparatus is operated not only for switching on-and-off said control valve but also for controllably shifting different water spraying patterns of said nozzle.

6. The water dispensing apparatus, as recited in claim 5, wherein said pusher member has a rod shape having two ends which are coupled at said two sides of said control valve respectively.

7. A water dispensing apparatus, comprising:

a dispensing body having a handle portion, an extension portion extended from said handle portion, an inlet channel provided at said handle portion, a receiving cavity formed at said extension portion, and an outlet channel, wherein said receiving cavity communicates with said inlet channel and said outlet channel, wherein said dispensing body further comprises a nozzle communicating with said outlet channel;

a control valve movably disposed in said receiving cavity, wherein said control valve comprises a water sealing member and a pusher member located eccentrically to a center of said control valve;

a control unit coupled to said control valve to drive said control valve to rotate within said receiving cavity so as to reciprocatingly move said pusher member in a pendulum path; and an actuation member slidably coupled along said outlet channel, wherein said actuation member has a front actuating end extended toward said nozzle and a rear actuating end coupled at said pusher member, wherein when said control unit is driven to move, said control valve is rotated correspondingly to reciprocatingly move said actuation member among different locations such that said front actuating end of said actuation member is moved away from said nozzle, said front actuating end of said actuation member is moved into said nozzle, or said front actuating end of said actuation member is moved through said nozzle, whereby through a reciprocating movement of said actuation member and a rotational movement of said control valve, said water dispensing apparatus is operated not only for switching on-and-off said control valve but also for controllably shifting different water spraying patterns of said nozzle.

8. The water dispensing apparatus, as recited in claim 7, wherein said pusher member has a rod shape.

* * * * *